United States Patent [19]

Shirakawa et al.

[11] Patent Number: 4,625,382

[45] Date of Patent: Dec. 2, 1986

[54] SPACE FORMING METHOD FOR SLIDE FASTENER CHAIN

[75] Inventors: Hiroshi Shirakawa; Shigeru Imai, both of Toyama, Japan

[73] Assignee: Yoshida Kogyo K.K., Tokyo, Japan

[21] Appl. No.: 675,615

[22] Filed: Nov. 28, 1984

[30] Foreign Application Priority Data

Dec. 12, 1983 [JP] Japan ..... 58-234818

[51] Int. Cl.[4] ..... B21D 53/50

[52] U.S. Cl. ..... 29/408

[58] Field of Search ..... 29/408–410, 29/766–770, 33.2

[56] References Cited

U.S. PATENT DOCUMENTS

| | | | |
|---|---|---|---|
| 4,019,240 | 4/1977 | MacFee | 29/408 |
| 4,241,489 | 12/1980 | Manning | 29/408 |
| 4,324,033 | 4/1982 | MacFee | 29/408 |
| 4,325,185 | 4/1982 | Kanzaka | 29/408 |

*Primary Examiner*—Howard N. Goldberg
*Assistant Examiner*—Steven Nichols
*Attorney, Agent, or Firm*—Hill, Van Santen, Steadman & Simpson

[57] ABSTRACT

A method of forming a so-called space where fastener elements have been removed from a slide fastener chain in which fastener elements of synthetic resin have been woven into the edges of fastener tapes comprising disengaging right and left stringers from each other, setting each stringer on a working bed, keeping fixed all fastener elements in the space forming area of each stringer on the working bed by respective press pieces at their engaging heads, cutting at least the connecting threads extending through the legs of each fastener element at the front and rear end of the space forming area of each stringer, then pulling the fastener tapes away from the respective press pieces and thus pulling out the binding warp threads, core string and connecting threads from the fastener elements, so as to remove the fastener elements from each fastener tape and keep the binding warp threads, core string and connecting threads extended along the space forming area in the weft loops.

3 Claims, 7 Drawing Figures

SPACE FORMING METHOD FOR SLIDE FASTENER CHAIN

BACKGROUND OF THE INVENTION

The present invention relates to a space forming method for a slide fastener chain, in other words to a method of forming a so-called space where fastener elements have been partially removed from a slide fastener chain in which fastener elements of synthetic resin have been woven into the edges of fastener tapes. More specifically, the present invention relates to a space forming method for a slide fastener chain in which fastener elements of synthetic resin each having an engaging head and a pair of legs originally extending to both sides of the engaging head and then bent about the engaging head into a U-shaped configuration have been woven into the edges of the fastener tapes with each element being connected in series by means of a core string, connecting threads and binding warp threads.

DESCRIPTION OF THE PRIOR ART

Methods of forming a space in a slide fastener chain where fastener elements have been removed or gaps therein formed have been shown in U.S. Pat. No. 4,324,033 and Japanese Patent Publicly Laid-Open No. 160502/80, etc. In these methods, however, cutting of the core string and connecting threads which connect each fastener element in series is performed between each adjacent fastener element in the space forming area before the fastener elements are removed. Therefore, the connecting threads and core string are all removed, and there is a danger that weft threads for securing fastener elements are cut or damaged also. As a result, the edge of the fastener tape in the space area is formed only by weft threads, which brings about the following disadvantages. Namely, the stiffness of the tape edge is lowered, the tape edge gets frayed due to the cutting or damage of the weft threads, and the appearance becomes poor.

SUMMARY OF THE INVENTION

Therefore, it is an object of the present invention to provide a space forming method for a slide fastener chain which lowers the possibility of cutting weft threads.

Another object of the present invention is to provide a space forming method for a slide fastener chain which allows the stiffness of the fastener tape edge to be maintained.

Still another object of the present invention is to provide a space forming method for a slide fastener chain which allows the good appearance of the fastener tape edge to the maintained.

These and other objects have been attained in a space forming method for a slide fastener chain wherein fastener elements are partially removed from the slide fastener chain to form a so-called space, said slide fastener chain being constructed such that each of said fastener elements being of synthetic resin and having an engaging head and a pair of legs originally extending to both sides of the engaging head and then bent about the engaging head into a U-shaped configuration is originally secured to the edge of the fastener tape which consists of a woven structure of warps and wefts by means of weft thread loops located between each fastener element, said weft thread loops passing around binding warp threads which hold the fastener elements therebetween, a core string held between both legs of the fastener elements and connecting threads held in grooves inside the legs of the fastener elements, all of said binding warp threads, core string and connecting threads extending along the row of fastener elements to connect each fastener element, by disengaging right and left stringers from each other, setting each stringer on a working bed, keeping fixed all fastener elements in the space forming area of each stringer on the working bed by respective press pieces at their engaging heads, cutting at least the connecting threads extending through the gap between the legs of each fastener elements at the front and rear end of the space forming area of each stringer, then pulling the fastener tapes away from the respective press pieces and thereby pulling out the binding warp threads, core string and connecting threads from the fastener elements, thus removing the fastener elements from each fastener tape and keeping the binding warp threads, core string and connecting threads extended along the space forming area in the weft thread loops.

Since the present invention is constructed as described above, the space forming method for a slide fastener chain according to the present invention brings about the following effects:

(1) Fastener elements in the space forming area can be removed from the fastener stringer without cutting or damaging the weft threads which secure the fastener elements.

(2) The stiffness of the fastener tape edge is maintained since the binding warp threads, core string and connecting threads are continuously held in place through the weft thread loops at the edge of the fastener tape.

(3) Good appearance of the fastener tape edge is maintained for the same reason as mentioned in (2) above.

The above and other objects and attendant advantages of the present invention will be more readily apparent to those skilled in the art from a reading of the following detailed description in conjunction with the accompanying drawings which show one preferred embodiment of the invention for illustration purposes only, but not for limiting the scope of same in any way.

DETAILED DESCRIPTION OF THE PREFERRED EMBODIMENT

Figure 1:
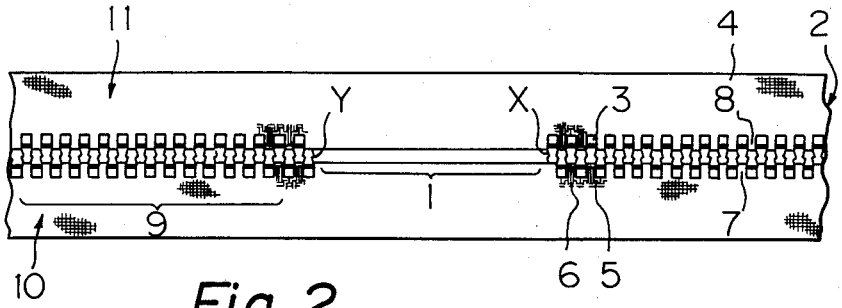
FIG. 1 is a plan view of one example of a slide fastener chain prepared according to the method of the present invention.

FIG. 1 shows an example of a slide fastener chain which has been provided with a space portion 1 according to the method of present invention. In this fastener chain, fastener elements 3 of thermoplastic synthetic resin are secured to the edges 7, 8 of the fastener tape by means of the woven structure of fastener tape 4 consisting of the wefts 5 and warps 6. Each of the fastener elements 3 has an engaging head 26 and a pair of legs originally extending to both sides of the engaging head and then bent about the engaging head into a U-shaped configuration, as shown in FIG. 3.

The method of the present invention is for removing fastener elements 3 only in the area in which a space is to be formed along a fastener chain in which a series of fastener elements have been secured as shown by reference numeral 9 of FIG. 1. At the first stage, right and left stringers 11, 10 of the slide fastener chain 2 are disengaged from each other, and are set on a working bed 12 as shown in FIG. 2 and FIG. 3.

Figure 2:
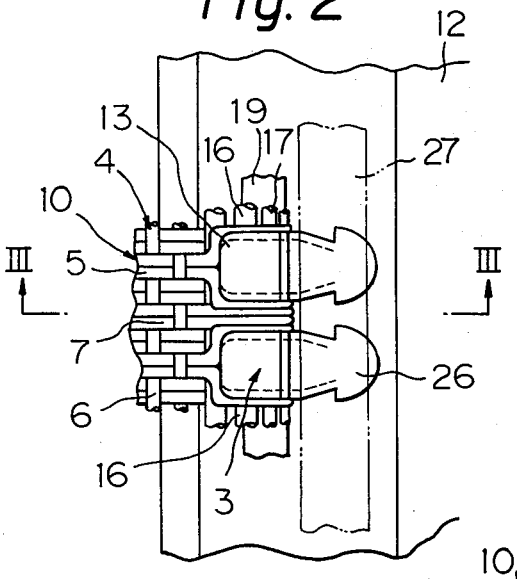
FIG. 2 is an enlarged plan view showing that the fastener elements in the space forming area are pressed by a press piece.
Figure 3:
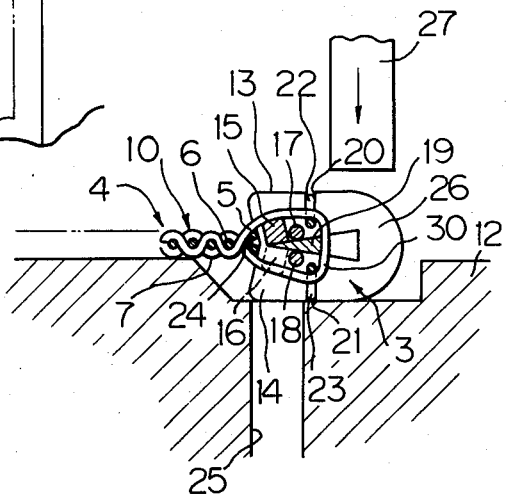
FIG. 3 is a sectional view along the line III—III of FIG. 2, which shows the first stage of the subject method.

Fastener elements 3 on each fastener stringer 10, 11 are connected with each other in series in such a way that connecting portions 15 extending between upper legs 13 of adjacent fastener elements and connecting portions 16 extending between lower legs 14 of adjacent fastener elements exist alternately in a zig-zag way as shown in FIG. 2 and FIG. 3. The fastener elements 3 are also connected with each other in series by connecting threads 17, 18 as shown in FIG. 2 and FIG. 3. Between the upper and lower legs 13, 14, a core string 19 is positioned.

Along the grooves 20, 21 formed on the outer surface of the upper and lower legs 13, 14 extend binding warp threads 22, 23. The binding warp threads 22, 23, supportive warp threads 24, warps 6 and wefts 5 form a woven structure and secure the fastener elements 3 to the edge 7 of the fastener tape 4.

In FIG. 3, an aperture through which a cutter is moved is shown in the working bed 12 by reference numeral 25. Detailed explanation is given later on this cutter.

Figure 4:
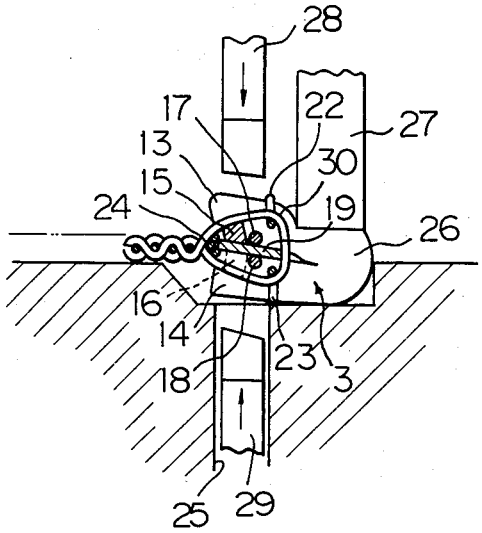
FIG. 4 is a sectional view similar to FIG. 3, which shows the second stage of the subject method.

After the stringers 10, 11 are set on the working bed 12 in the first stage mentioned before, all fastener elements 3 in the space forming area are press-fixed onto the working bed 12 by a press piece 27 at the engaging head 26 side in the second stage. FIG. 4 shows the condition wherein the second stage has been finished. At this point, the fastener element 3 has been entirely deformed under the force applied by the press piece 27 from the engaging head 26 to the upper and lower legs 13, 14. Due to this deformation, the area where the grooves 20, 21 lie is expanded and the grooves almost disappear. Thus, the binding warp threads 22, 23 become ready to be disengaged from the outer surface of the upper and lower legs 13, 14.

The core string 19 also becomes ready to be taken out through the gap between the upper leg 13 and lower leg 14, because the upper and lower legs are opened by virtue of the deformation.

After the above-mentioned condition has been achieved, cutters 28 and 29 are moved downwardly and upwardly, respectively, as shown in FIG. 4 to cut the connecting threads 17, 18 and the connecting portions 15 between the upper legs 13 or the connecting portions 16 between the lower legs 14 at the front and rear ends of the space forming area, namely at the points X, Y shown in FIG. 1 between the area where the fastener elements are to be removed and the area where the fastener elements are to be kept. If the fastener elements are not connected in series by connecting portions 15, 16 in, for example, a zig-zag way as mentioned before, the cutters 28, 29 cut only the connecting threads 17, 18.

Figure 5:
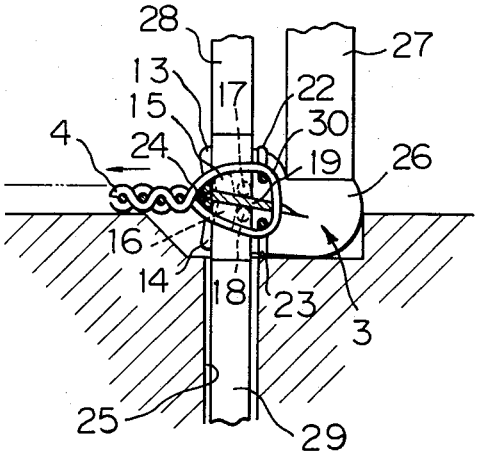
FIG. 5 is a sectional view similar to FIG. 3, which shows the third stage of the subject method.

FIG. 5 shows the connecting portion 15 or 16 and the connecting threads 17, 18 having just been cut.

Figure 6:
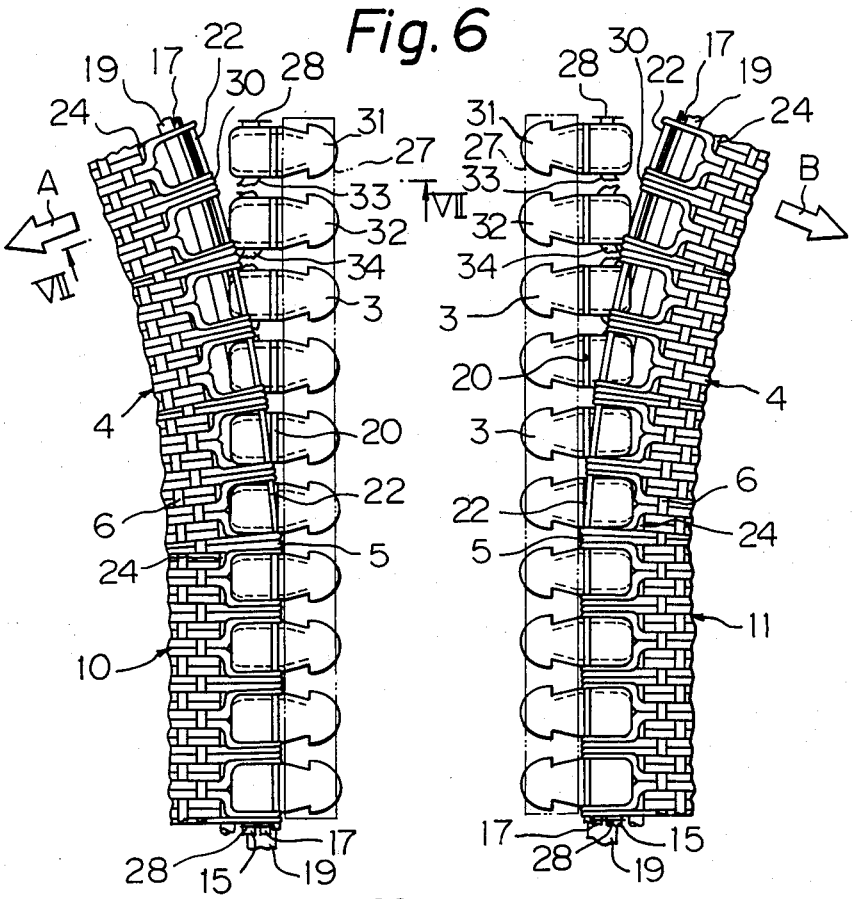
FIG. 6 is an enlarged plan view, which shows the fourth stage of the subject method.
Figure 7:
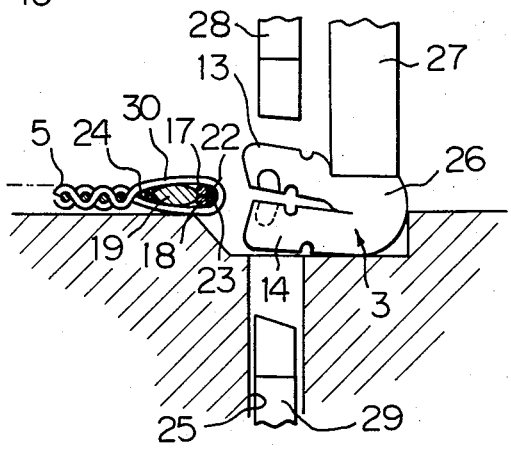
FIG. 7 is a sectional view along the line VII—VII of FIG. 6.

After the third stage has been finished, each fastener tape 4 is pulled away from the respective press piece 27 as shown in FIG. 6 in the fourth stage. It is desirable that the fastener tape is pulled away from the press piece 27 at the cut position on one side in the plane in which the fastener stringers 10, 11 lie in such a way as to describe a circular arc. In other words, the fastener tape is pulled out of the fastener elements one after another along the row of fastener elements starting from the fastener element closest to the cut position on one side. In FIG. 6, the arrows A, B show the direction in which the fastener tapes are pulled. The fastener elements not shown in FIG. 6 adjacent to the fastener element 31 at the upper end of the row of fastener elements, is not pressed-fixed on the working bed 12 by the press piece 27. Therefore the adjacent fastener elements are also pulled away together with each fastener tape such as to describe a circular arc. Since each fastener tape is pulled at the cut position on one side so as to describe a circular arc, the connecting threads 17, 18, core string 19 and binding warp threads 22, 23 each extending through weft thread loops 30 are pulled out of the row of fastener elements 3 which are press-fixed on the working bed 12 by the press piece 27 in the space forming area as shown in FIG. 7. As a result, the connecting threads 17, 18, core string 19, binding warp threads 22, 23 and supportive warp threads 24 remain and are held in the loops 30 of the weft threads 5. Cutting the front and rear end of the space-forming area as shown in FIG. 6, is important. The connecting threads 17, 18 are originally held by the fastener elements 3 rather more firmly than the others 19, 22, 23, because the former are embedded integrally, or by molding, within recesses of each fastener element 3. (See FIGS. 3, 7). Accordingly, at the point where each fastener tape starts to be pulled such as to describe a circular arc as shown in FIG. 6, the connecting threads 17, 18 tend to remain in the recesses of the fastener element 31 for a while. As a result, if threads 17, 18 are not cut, the connecting threads 17, 18 in the fastener elements held pull toward the press piece 27, the adjacent, unheld, fastener element being pulled, and this causes the adjacent fastener elements being pulled to lean away from their regular perpendicular position relative to the threads 17, 18 at the portion near the frontal and rear ends of the fastener tape 4. In this circumstance, it would be difficult, and sometimes impossible, for the rows of fastener elements 3 to be engaged with each other in a regular manner adjacent the space where the elements are removed. Cutting the connecting threads 17, 18 at the front and rear end of the space-forming area in advance, prevents this angled deformation and disruption.

In the operation of pulling out the connecting threads 17, 18 and core string 19 etc., force is applied to each fastener element one after another, namely, first the fastener element 31 at the end of the row of fastener elements 3, then the next fastener element 32, and so on. Therefore, the connecting portions 15, 16 between fastener elements 3 are cut by the loops 30 of the weft threads as shown by reference numeral 33, 34 in FIG. 6. Note that the connecting portions 15, 16 are rather thin, and they can be cut easily by the weft thread loops 30 which have higher strength. When the connecting threads 17, 18 are pulled out of the fastener elements 3, they are first disengaged from the grooves inside the upper and lower legs 13, 14 as will be understood from FIG. 7.

After the fourth stage is completed, the fastener stringers 10, 11 are meshed together again, as is shown in FIG. 1, and thus all the stages in the method of the subject invention are completed.

What is claimed is:

1. A space forming method for a slide fastener chain wherein fastener elements are partially removed from a slide fastener chain to form a so-called space, said slide fastener chain being constructed such that each of said fastener elements being of synthetic resin and having an engaging head and a pair of legs originally extending to both sides of the engaging head and then bent about the engaging head into a U-shaped configuration is originally secured to the edge of the fastener tape which consists of a woven structure of warps and wefts by means of weft thread loops located between each fastener element, said weft thread loops passing around binding warp threads which hold the fastener elements therebetween, a core string held between both legs of the fastener elements and connecting threads held in grooves inside the legs of the fastener elements, all of said binding warp threads, core string and connecting threads extending along the row of fastener elements to connect each fastener element, the improvement comprising:

right and left stringers are disengaged from each other;

each stringer is set on a working bed;

all fastener elements in the space forming area of each stringer are kept fixed on the working bed by respective press pieces at their engaging heads;

at least the connecting threads extending through the legs of each fastener element are cut at the front and rear end of the space forming area of each stringer;

then the fastener tapes are pulled away from the respective press pieces, thereby pulling out the binding warp threads, core string and connecting threads from the fastener elements;

whereby the fastener elements are removed from each fastener tape, and the binding warp threads, core string and connecting threads extended along the space forming area are kept in the weft loops.

2. A space forming method for a slide fastener chain according to claim 1, wherein each adjacent element of said fastener elements is connected to each of its neighbours by two connecting portions between upper legs and between lower legs or by one of said two connecting portions alternately one pitch by one pitch in a zig-zag fashion.

3. A space forming method of a slide fastener chain according to claim 2, wherein said connecting portion or portions are cut together with said connecting threads extending through the legs of each fastener element.

* * * * *